United States Patent [19]

Umeda et al.

[11] Patent Number: 4,633,824

[45] Date of Patent: Jan. 6, 1987

[54] COOLING MEANS FOR THE SQUISH PART OF AN AIR COOLING OVERHEAD VALVE ENGINE

[75] Inventors: Tatsutoshi Umeda; Yoshio Tani; Takeshi Kaai; Keiichi Nakano; Yoshio Izui, all of Sakaishi, Japan

[73] Assignee: Kubota Limited, Osaka, Japan

[21] Appl. No.: 704,955

[22] Filed: Feb. 25, 1985

[30] Foreign Application Priority Data

Mar. 30, 1984 [JP] Japan ..... 59-47406[U]
May 9, 1984 [JP] Japan ..... 59-92567
May 16, 1984 [JP] Japan ..... 59-72119[U]

[51] Int. Cl.[4] ..... F01P 1/02

[52] U.S. Cl. ..... 123/41.65; 123/41.69; 123/193 H

[58] Field of Search ..... 123/41.62, 41.65, 41.66, 123/41.69, 41.82 R, 193 H, 193 CH

[56] References Cited

U.S. PATENT DOCUMENTS 3,650,249 3/1972 Honda ..... 123/41.65
3,669,082 6/1972 Hatz ..... 123/41.65

FOREIGN PATENT DOCUMENTS 2824132 12/1978 Fed. Rep. of Germany ... 123/41.82 R
2069598 8/1981 United Kingdom ..... 123/41.65

*Primary Examiner*—William A. Cuchlinski, Jr.
*Attorney, Agent, or Firm*—Schwartz, Jeffery, Schwaab, Mack, Blumenthal & Evans

[57] ABSTRACT

The present invention relates to a cooling means for the squish part of an air cooling over head valve engine, comprising a fan disposed in front of said engine for generating cooling wind. A fan case is provided which covers the front side of the fan and engine. A wind tunnel is formed through the cylinder head of said engine near the squish area and is aligned so as to pass a cooling wind, generated by the fan, above the squish area. The engine is provided with an intake and exhaust ports opening at the front and rear surfaces of said cylinder head, respectively. In the lateral side of the wind tunnel, an intake or exhaust pipe is disposed laterally over the front space of the tunnel, so as to guide cooling wind blown up from the fan to the tunnel along its lower peripheral surface thereof.

8 Claims, 7 Drawing Figures

COOLING MEANS FOR THE SQUISH PART OF AN AIR COOLING OVERHEAD VALVE ENGINE

BACKGROUND OF THE INVENTION

1. Field of the Invention

The present invention relates to a cooling means for the squish part, namely, the wall part over the squish area formed underthe cylinder head of an air cooling over head valve engine, which involves a fan in front thereof, and a wind tunnel for cooling the squish part.

2. Related Art

A cooling means for the squish part of an air cooling over head valve engine is well known to those who are skilled in the art.

Such cooling means comprises a fan disposed in front of the engine for generating cooling wind; a fan case which covers the front side of the fan and the engine; a wind tunnel formed through the cylinder head of the engine near the squish area for passing a part of cooling wind generated by the fan; and a baffle plate fixed to the interior surface of the fan case for guiding cooling wind blown up from the fan to the wind tunnel so that the squish area of the engine is cooled by the wind passing through the wind tunnel.

However, the baffle plate is made separately and then welded to the fan case. Thus, the number of parts is increased, and the forming and welding of the plate takes excessive time, so that manufacturing cost is expensive. Moreover, the resonance of the baffle plate with the engine may bring about sounding and fracture from fatigue.

Moreover, in a known cooling means of the squish area, another baffle plate is disposed for dividing cooling wind into two directions namely, to the wind path around the whole cylinder including the wind tunnel.

However, this baffle plate located about at the boundary between the cylinder and the cylinder head is elongated inside of the fan case therefrom, reducing the sectional area of the wind path to the cylinder head. As such, a smaller volume of cooling wind is delivered to the wind path behind the plate, and that a strain on the cylinder head may arise from the insufficiency of the cooling. Moreover, the insufficiency of the cooling may result in accumulation of heat at the squish part and the combustion chamber, causing preignition, and knocking. Consequently, the engine may not be suitable for conditions with high combustion temperatures, such as high speed running, or high compression ratio. And, sounding and fracture from fatigue of this plate may be brought only by the resonance thereof, too.

As described in Japanese Utility Model Issue Sho 59-5130, such a wind tunnel has a bottom surface with a stair graded up above the squish area. Thus the thickness of the cylinder head is decreased at the stair part, and the amount of the heat accumulated at the stair part becomes larger to invite preignition and knocking.

SUMMARY OF THE INVENTION

Therefore, the primary object of the present invention is to decrease the number of the parts, so as to simplify the cooling means and make it cheaper.

The second object of the present invention is to eliminate sounding and fracture from the fatigue caused by the installation of these baffle plates.

To achieve these objects, a cooling means for the squish part of an air cooling over head valve engine, according to the present invention, comprises a fan disposed in front of said engine for generating cooling wind. A fan case covers the front side of said fan and engine and a wind tunnel is formed through the cylinder head of said engine near to the squish area and alined before and behind for passing a part of cooling wind generated by the fan. The engine is provided with an intake or exhaust port opened at the front surface of said cylinder head in the lateral side of said wind tunnel, and an intake or exhaust pipe is communicated with said port and elongated laterally over the front space of said tunnel. In this manner, the cooling wind blown up from said fan to said tunnel is guided by by the lower peripheral surface thereof.

The other object of the present invention is to avoid the strain of the cylinder head, resulting from uneven cooling of thereof.

To achieve this object, the cooling means for the squish part according to the present invention is provided with a choked path between the lower peripheral surface and the inlet of the wind tunnel to divide into two ways, one to the tunnel, another to the wind path around the cylinder head, preferably to determine the delivery ratio of the cooling wind to these two ways by resistance produced from the choking effect thereof.

A further object of the present invention is to avoid the accumulation of the heat at the cylinder head and preignition, and the knocking, so that the engine may be suitable for conditions with high combustion temperatures, such as high speed running, or high compression ratio.

To achieve this object, the engine is provided with a passage at the outer lateral side of said squish area, and the wind tunnel located between the walls of said passage and the ports, is provided with a flat bottom surface between said walls, and a port side surface inclined to aproach to said combustion chamber as it descends lower, preferably along the contour of the seat where the exhaust or inlet pipe is fixed on.

BRIEF DESCRIPTION OF THE DRAWINGS

The other objects of the present invention would be clarified and understood more clearly by reading the detailed description of the invention described below, referring to the attached drawings, wherein.

DETAILED DESCRIPTION OF THE PREFERRED EMBODIMENTS

Figure 1:
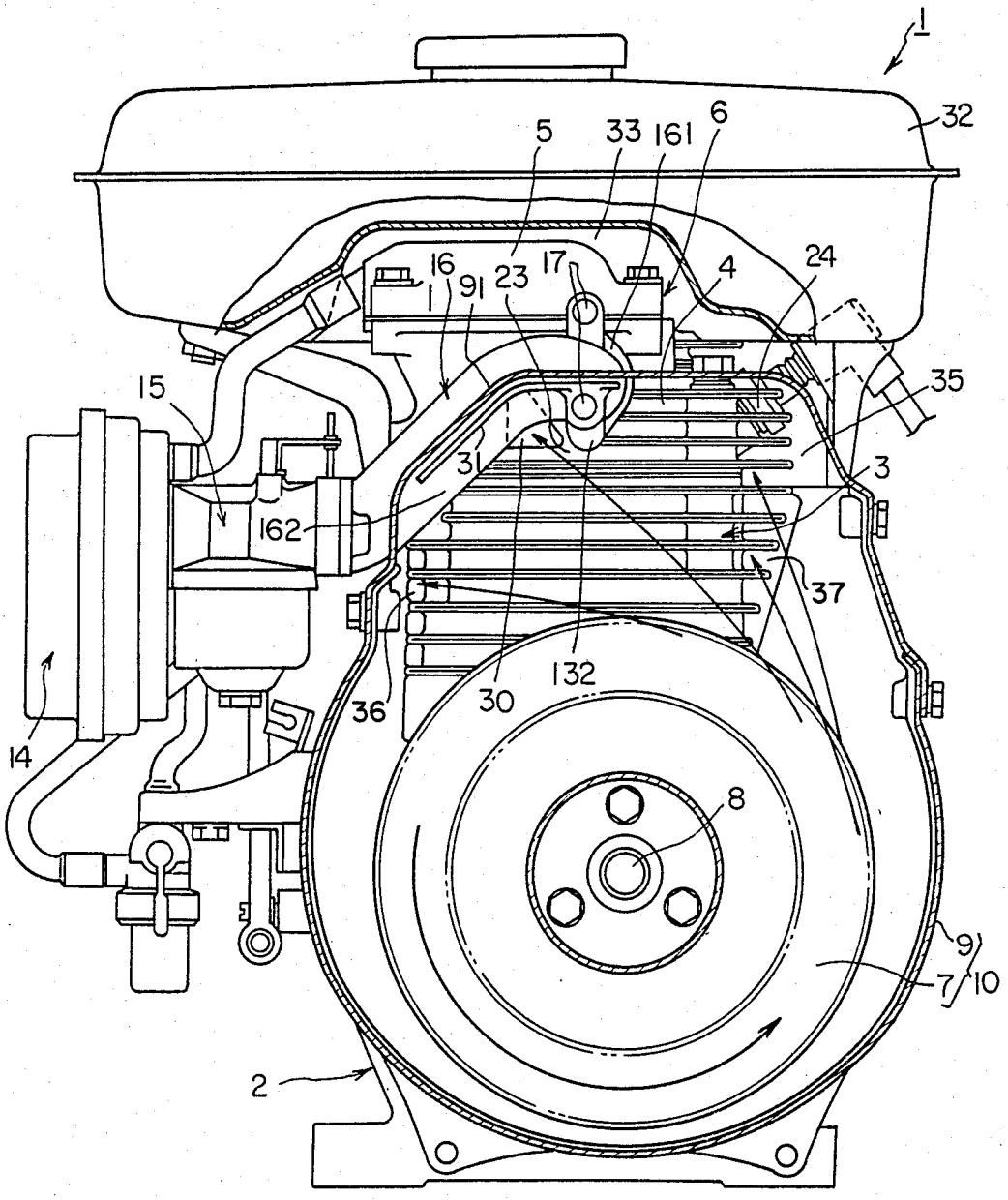
FIG. 1 is a partially sectioned front view of the over head valve engine according to the present invention.
Figure 2:
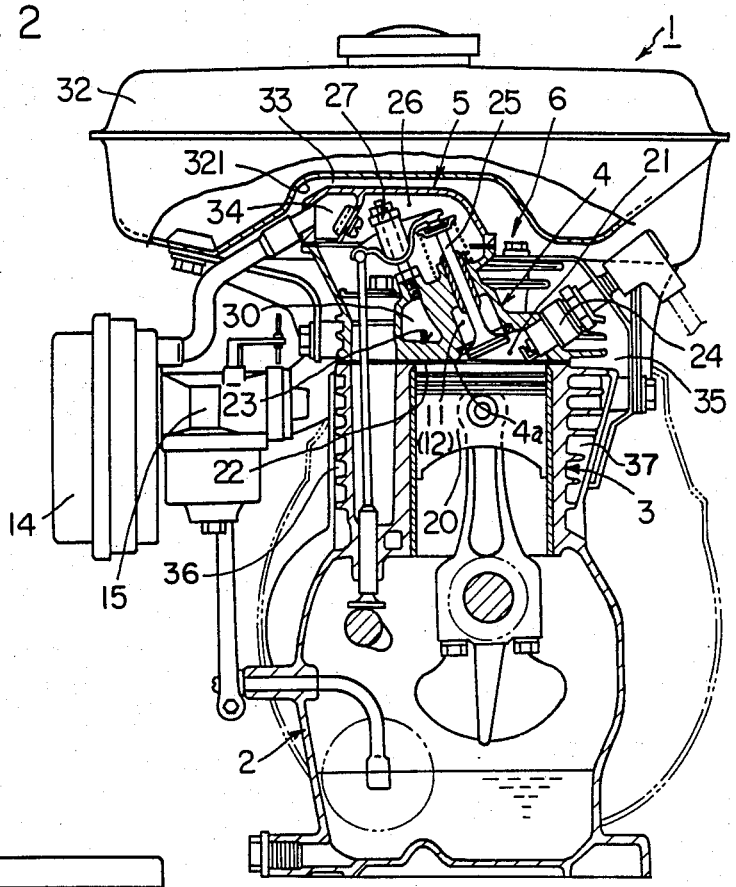
FIG. 2 is a central section of the engine according to the present invention.

Now referring to the FIGS. 1 and 2, the engine 1 according to the present invention has a main body comprising a crank case 2, a cylinder block 3 casted in a body with the crankcase 2, a cylinder head 4 and rocker arm cover 6 bolted on the cylinder block 3.

A fly wheel fan 7 is located in front of the crank case 2, suported by the crank shaft 8 at the end thereof, so as to constitute a wind supplying system 10 with a fan case which covers the periphery of the fan 7.

Figure 3:
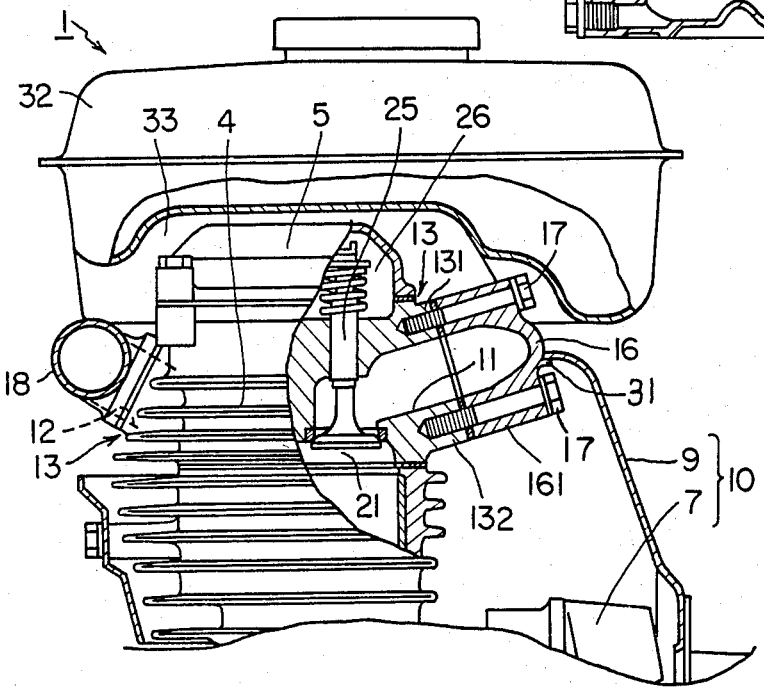
FIG. 3 is a partially sectioned fragmentary side view of the engine according to the present invention.
Figure 4:
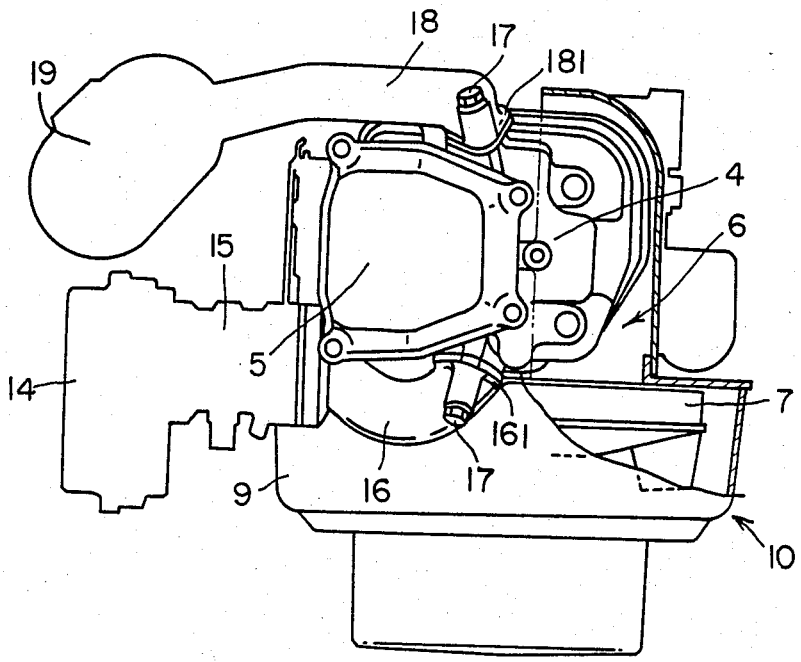
FIG. 4 is a plane view of the engine according to the present invention ommiting its fuel tank.
Figure 5:
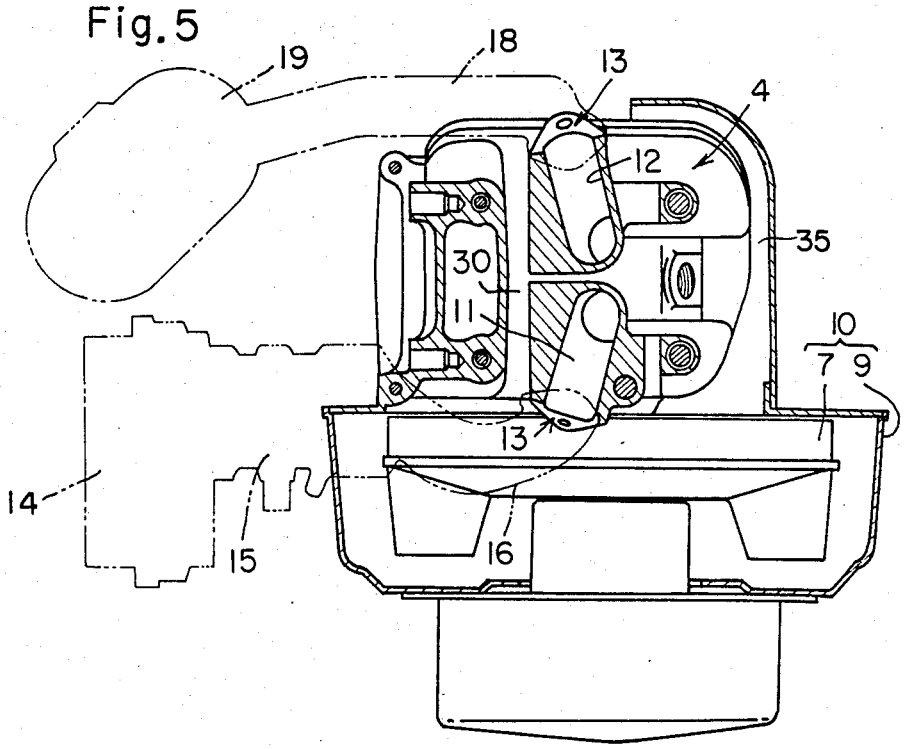
FIG. 5 is a horizontal section of the cylinder head of the engine according to the present invention.

As seen in the FIG. 3, an end of the intake port 11 opens at the front surface of the cylinder head 4, and the exhaust port 12 opens at the rear surface of the cylinder head 4. The seats 13 for fixing intake and exhaust pipes are lozenge shaped, i.e. they are vertically long and laterally short, surounding each end of these ports 11 and 12. The surface of the seats 13 are inclined inside at the upper part 131 and outside at the lower part 132 thereof.

On the inclined surface of the seat 13 formed around the intake port 11, the flange 161 of an intake pipe 16 which has an air cleaner 14 and a carburetor 15 at the other end thereof is fixed by a pair of bolts 17. On the inclined surface of the other seat 13 formed around the exhaust port 12, the flange 181 of an exhaust pipe 18 which has a silencer 19 at the other end thereof is fixed by another pair of bolts 17.

As seen in FIG. 2, the cylinder head 4 provided with a combustion chamber 21 recessed upwardly at the right half of its inside surface 41, and a squish area 22 at the left half thereof. The wall part over the squish area 22 is called squish part 23.

The combustion chamber 21 is provided with an ignition plug 24, intake and exhaust valves 25 which are closed and shut by a valve moving mechanism 27 partially disposed in the rocker arm chamber 26, so as to communicate the combustion chamber 21 with the intake port 11 or the exhaust port.

A wind tunnel 30 extends through the cylinder head 4, the squish part 23 being disposed between the squish area 22 and rocker arm chamber 26, so as to pass a cooling wind generated by the fan 7 fixed on the end of the crank shaft 8 for cooling the squish part 23.

This tunnel 30 extends across the length of the cylinder; the wind path 34 is formed outside of the combustion chamber 21 for providing additional cooling. Air paths 36 and 37 are disposed around the cylinder, and air path 35 is disposed along combustion chamber 21.

The intake pipe 16 is elongated laterally over the front space of the tunnel 30, so as to guide cooling wind blown up from the fan 7 to the tunnel 30 by the lower peripheral surface 162 of the pipe 16. To assist the guidance of the cooling wind by the pipe, a rib or vane 31 is extruded from the front surface of the pipe 16 along the length thereof. A choking path is formed between the lower peripheral surface 162 and the front surface of the cylinder hear 4 to determine the delivery ratio of the cooling wind to the wind tunnel 30 and the rest wind path of the cylinder head 4. Since no baffle plate is provided for the determination of the abovementioned delivery ratio, the cooling wind may be introduced to the whole wind path for the cylinder head 4 without any disturbance. Thus, the cylinder head 4 is cooled sufficiently and evenly, and the strain of the cylinder head 4 by uneven cooling may be satisfactorily eliminated.

Figure 6:
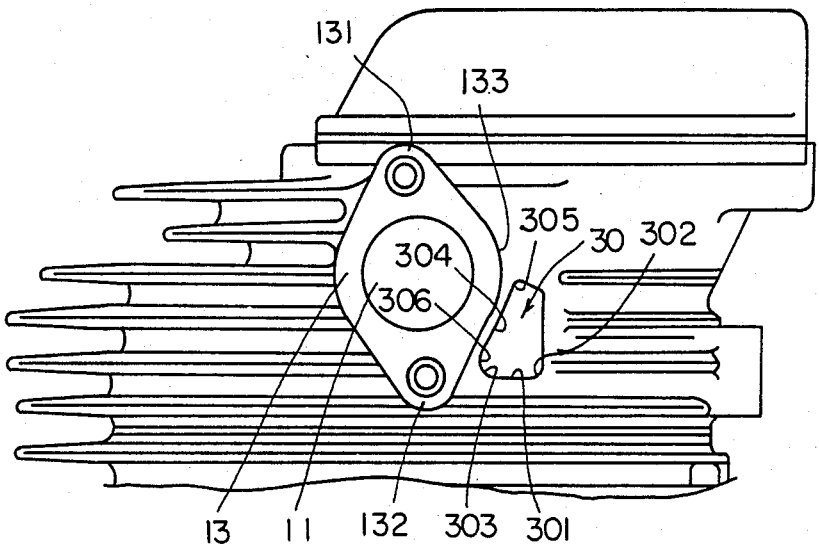
FIG. 6 is a fragmentary rear view of the engine according to the present invention.

As seen in FIG. 6, the tunnel 30 is provided with a bottom surface 301 which is parallel with the top surface of the squish area 22 and flat between the walls of the push rod hole and of the intake and exhaust ports, namely, for the total width from the right end 302 to the left end 303 thereof. The tunnel 30 is also provided with a port side surface 304 inclined from the top 305 to the bottom 306 for total length thereof, approaching the combustion chamber 21 as it descends lower, preferably along the contour 133 of the seat which the exhaust pipe 18 is fixed on. In this particular section of the wind tunnel 30, the thickness of the squish part 23 is made thinner than that of the known type, so that the squish part 23 is cooled sufficiently to avoid over heating thereof, and consequently, to avoid preignition and knocking by over heating thereof.

Figure 7:
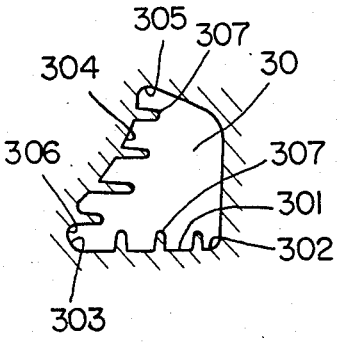
FIG. 7 is a fragmentary rear view of another engine according to the present invention.

As seen in FIG. 7, the wind tunnel may be advantageously provided with fins 307 to improve the cooling efficiency by enlarging the surface area through which heat is transferred.

It would be understood that the invention is not limited by the preferred embodiments but including all such modifications and variations within the spirit and scope of the invention claimed as would be obvious to those skilled in the art.

What is claimed is:

1. An air cooled engine comprising:
(a) a cylinder having a cylinder head affixed thereon and having a right side and a left side;
(b) a combustion chamber disposed in an upper area of said cylinder and under the right side of said cylinder head;
(c) a squish area disposed in said cylinder adjacent to said combustion chamber under and across the left side of said cylinder head;
(d) an air wind tunnel disposed above said squish area and extending through said cylinder head and over substantially the entire squish area;
(e) a squish part including a portion of said cylinder head disposed between said air wind tunnel and said squish area;
(f) a fan means for providing a cooling wind;
(g) a fan case for guiding the cooling wind to said air wind tunnel;
(h) a pipe means disposed across an upper part of an entrance of said wind tunnel for guiding the cooling wind into said wind tunnel.

2. The air-cooled engine of claim 1, further comprising:
an air path disposed around said cylinder block; and
a fan case for directing the cooling wind to said air path.

3. The air cooled engine of claim 2, including a means for providing a delivery ratio of cooling wind to said air wind tunnel and said air path which is a function of the resistance produced from a choking effect of the air path between said pipe and said entrance of said wind tunnel.

4. The air cooled engine of claim 1, further comprising a rib means extending along said pipe for directing the cooling wind around said pipe and into said air wind tunnel.

5. The air cooled engine of claim 1, further comprising fin means disposed on inner walls of said air wind tunnel for providing additional surface area whereby the cooling efficiency is enhanced.

6. The air cooled engine of claim 1, further comprising an air path disposed along said combustion chamber.

7. An air cooled engine comprising:
(a) a cylinder;
(b) a combustion chamber disposed in an upper area of said cylinder;
(c) a squish area disposed in said cylinder adjacent to said combustion chamber;
(d) an air wind tunnel disposed above said squish area;

(e) a squish part disposed between said air wind tunnel and said squish area;
(f) a fan means for providing a cooling wind;
(g) a fan case for guiding the cooling wind to said air wind tunnel;
(h) a pipe means disposed across an upper part of an entrance of said wind tunnel for guiding the cooling wind into said wind tunnel;
(i) said wind tunnel being disposed adjacent to a pair of intake and exhaust ports; and
(j) said wind tunnel having a substantially flat lower surface and an inclined side surface which intersects said lower surface at an acute angle and is inclined toward said combustion chamber.

8. An air cooled engine comprising:
(a) a cylinder;
(b) a combustion chamber disposed in an upper area of said cylinder;
(c) a squish area disposed in said cylinder adjacent to said combustion chamber;
(d) an air wind tunnel disposed above said squish area;
(e) a squish part disposed between said air wind tunnel and said squish area;
(f) a fan means for providing a cooling wind;
(g) a fan case for guiding the cooling wind to said air wind tunnel;
(h) a pipe means disposed across an upper part of an entrance of said wind tunnel for guiding the cooling wind into said wind tunnel;
(i) an air path disposed around said cylinder block;
(j) a fan case for directing the cooling wind to said air path;
(k) a means for providing a delivery ratio of cooling wind to said air wind tunnel and said air path which is a function of the resistance produced from a choking effect of the air path between said pipe and said entrance of said wind tunnel;
(l) intake and exhaust ports being disposed inside a seat means; and
(m) an inclined surface of said wind tunnel being formed along a contour of said seat means.

* * * * *